United States Patent [19]

Euteneuer et al.

[11] Patent Number: 4,619,452

[45] Date of Patent: Oct. 28, 1986

[54] PHOTOGRAPHIC PRINT SORTER

[75] Inventors: Charles L. Euteneuer, St. Michael; Robert E. Diesch, Rogers, both of Minn.

[73] Assignee: Pako Corporation, Minneapolis, Minn.

[21] Appl. No.: 623,098

[22] Filed: Jun. 21, 1984

[51] Int. Cl.[4] ..... B65H 5/16; B65H 29/62

[52] U.S. Cl. ..... 271/305; 209/657; 271/209; 271/272

[58] Field of Search ..... 209/3.1–3.3, 209/656, 657, 534, 569, 571, 583, 918; 271/209, 303, 305, 264, 272, 274, 297; 221/43, 231, 259

[56] References Cited

U.S. PATENT DOCUMENTS

| | | | |
|---|---|---|---|
| Re. 29,792 | 10/1978 | Tramposch | 271/303 X |
| 698,597 | 4/1902 | Votaw | 209/571 X |
| 1,847,533 | 3/1932 | Lasker et al. | 209/571 |
| 3,804,242 | 4/1974 | Tall et al. | 209/3.3 X |
| 4,114,349 | 9/1978 | Jensen et al. | 53/54 |
| 4,260,148 | 4/1981 | Diesch et al. | 271/219 |
| 4,313,669 | 2/1982 | Larson et al. | 354/354 |
| 4,340,213 | 7/1982 | Jensen | 271/219 |
| 4,345,754 | 8/1982 | Willenbring | 271/209 |

FOREIGN PATENT DOCUMENTS

| | | | |
|---|---|---|---|
| 0672931 | 10/1964 | Italy | 209/657 |
| 1386945 | 3/1975 | United Kingdom | 271/209 |

*Primary Examiner*—Robert B. Reeves
*Assistant Examiner*—Edward M. Wacyra
*Attorney, Agent, or Firm*—Kinney & Lange

[57] ABSTRACT

A photographic print sorter has a series of print slides along which the photographic prints are driven by drive rollers. Deflectors which are movable into the flow path are positioned between the print slides selectively deflect the prints into good, reject and remake print trays. Each print slide has a recess below each drive roller. The radius of each drive roller is betwen about 0.005 inches and about 0.045 inches greater than the distance from the axis of the drive shaft to the transport plane defined by the top surface of the print slide. This creates an interference fit between the drive rollers and the photographic print as the print is driven over the print slide.

7 Claims, 8 Drawing Figures

PHOTOGRAPHIC PRINT SORTER

BACKGROUND OF THE INVENTION

1. Field of the Invention

The present invention relates to photographic processing equipment. In particular, the present invention is a print sorter for automatically sorting individually cut photographic prints.

2. Description of the Prior Art

In commercial photographic processing operations, very high rates of processing need to be achieved and maintained in order to operate profitably. To expedite the photographic processing, orders containing film of similar type and size are spliced together for developing.

After developing, the photographic images contained in the film negatives are printed in edge-to-edge relationship on a continuous strip of photosensitive print paper by a photographic printer. The photographic printer causes high intensity light to be passed through the negative and imaged onto the photographic print paper. The photographic emulsion layers on the print paper are exposed and are subsequently processed to produce a print of the image contained in the negative.

After the strip of photographic print paper has been processed, the prints are inspected by an operator. Remake and reject prints are identified by marks made on the face of the particular print by the operator. A photographic paper cutter then cuts individual prints from the strip, and the prints are sorted by customer order (either manually or automatically) and ultimately packaged and sent to the customer.

Automatic print sorters have been developed to sort the prints of each customer order into good, remake and reject categories. Examples of automatic sorting apparatus are described in the following U.S. Pat. Nos.: Jensen et al 4,114,349; Diesch et al 4,260,148; Larson et al 4,313,669; Jensen 4,340,213; and Willenbring 4,345,754.

In each of these patents, individually cut prints are fed to a conveyor bed formed by a series of print slides, and are driven by drive rollers positioned above the print slides. The drive rollers apply the driving force to the print by engaging the top surface of the print.

In the past, the spacing of the drive rollers from the top surface of the print slide in a print sorter of this type has been difficult to maintain accurately and yet such accuracy is critical to the proper operation of the sorter. If the drive rollers become misaligned the printer may be misfed or become skewed in the feed path. The prints are driven at high speed and care must be taken to avoid damaging the top surface of the print, which contains the photographic image. The average print is on the order of 0.010 inches thick, and therefore the tolerance in the adjustment of the spacing between the drive roller and the top surface of the print slide is quite difficult. In addition, the requirement of adjustability of the position of the drive shafts greatly complicates the design and increases the parts count of the sorter.

SUMMARY OF THE INVENTION

The present invention is an improved print sorter which eliminates the need for adjustment of the drive roller position. This is achieved by creating an interference fit between the drive rollers and the print.

In the present invention, the print slide of the print sorter has recesses positioned opposite the drive rollers.

Each drive roller has a radius which is greater than the spacing of the drive shaft from the drive plane defined by the top surfce of the print slide. As each print passes between the drive roller and the print slide, there is an interference fit between the drive roller and the print, thus eliminating any need for adjustment of drive roller position. In addition, each driver roller has a compliant outer surface to prevent damage to the print as it is engaged by the drive roller.

In preferred embodiments, the radius of each drive roller is dimensioned such that the lower surface of the roller extends below the top surface of the print slide a distance ranging from about 0.005 inch to 0.045 inch. The interference fit created between the compliant outer surface of the drive rollers and the print provides positive drive of each print, without damage to the photographic image on the top surface of the print which is engaged by the drive rollers.

DETAILED DESCRIPTION OF THE PREFERRED EMBODIMENTS

Figure 1:
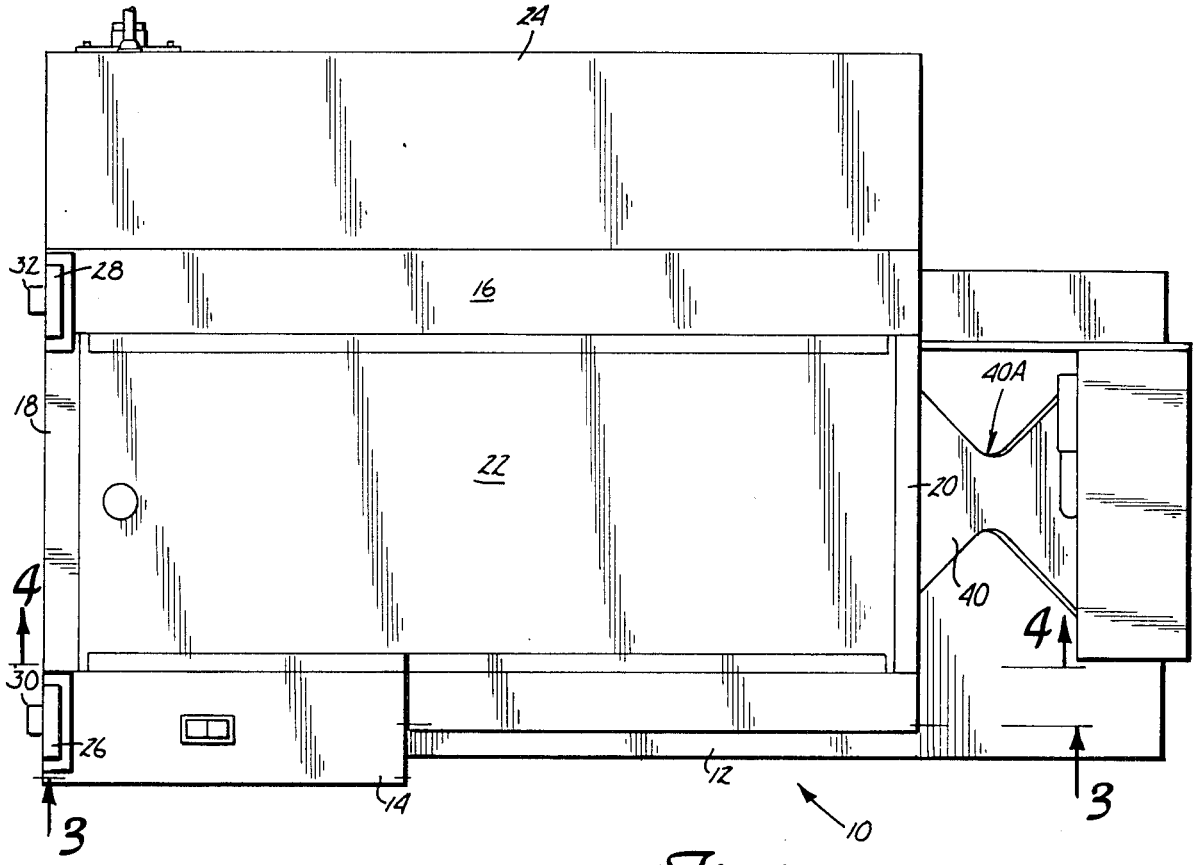
FIG. 1 is a top view of the print sorter of the present invention.
Figure 2:
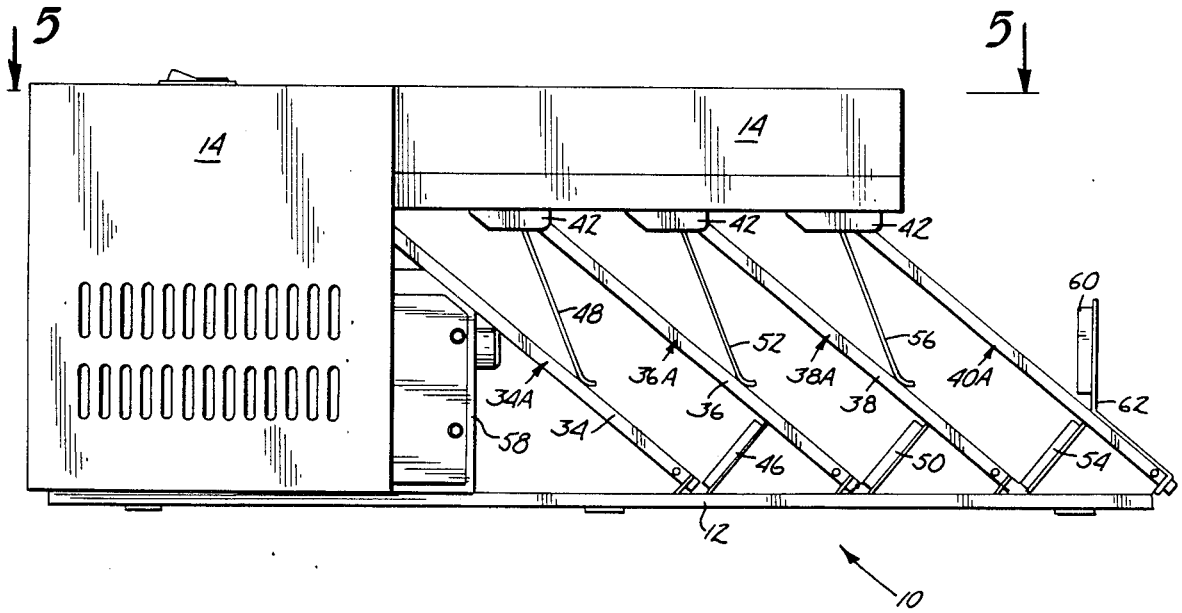
FIG. 2 is a front view of the print sorter of the present invention.

FIGS. 1 and 2 show external top and front views of print sorter 10 of the present invention. Print sorter 10 has a main housing formed by base 12, front cover 14, rear cover 16, left end cover 18, right end cover 20, and top cover 22. Abutting rear cover 16 is power supply housing 24, which houses the electrical circuitry required to power and control operation of print sorter 10.

Print sorter 10 is intended for use in conjunction with a photographic paper cutter, such as the Pako PC305 paper cutter which is described in U.S. Pat. No. 4,128,887 by G. Strunc and F. Laciak, as well as automatic photographic paper cutters manufactured by other manufacturers. At the left end of print sorter 10 are a pair of latch hasps 26 and 28 and a pair of bumpers 30 and 32. The paper cutter and print sorter 10 are latched together during operation, to provide positive alignment and no relative motion between the two machines.

Photographic prints are cut from a continuous web of photographic print paper by a knife assembly of the print cutter. Print sorter 10 sorts the cut prints into good, remake and reject prints. This sorting is done on the basis of remake and reject indicia which are applied to the face of the remake and reject prints prior to the cutting and sorting operation. The indicia are sensed by a remake/reject sensor which is located on the print cutter before the knife assembly of the cutter. Signals from the print cutter are interfaced with the control circuitry of print sorter 10 which is contained within power supply housing 24.

Figure 3:
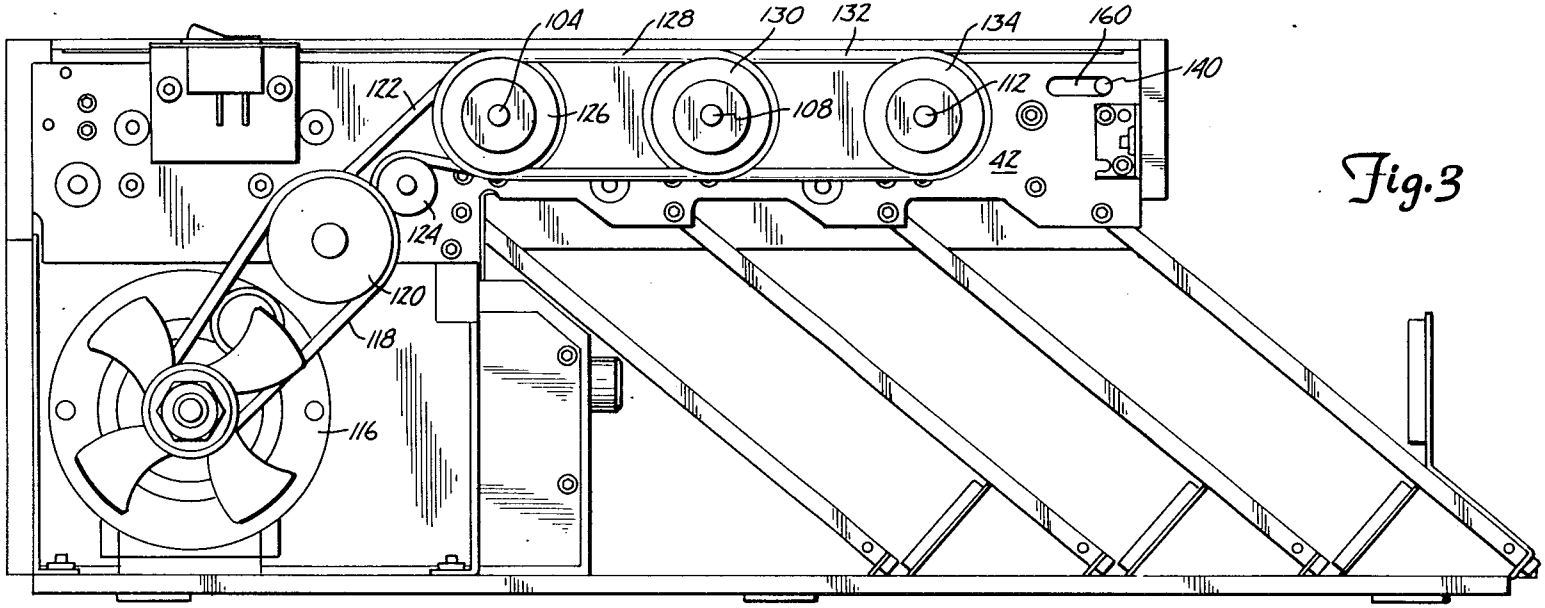
FIG. 3 is a sectional view along section 3—3 of FIG. 1.
Figure 4:
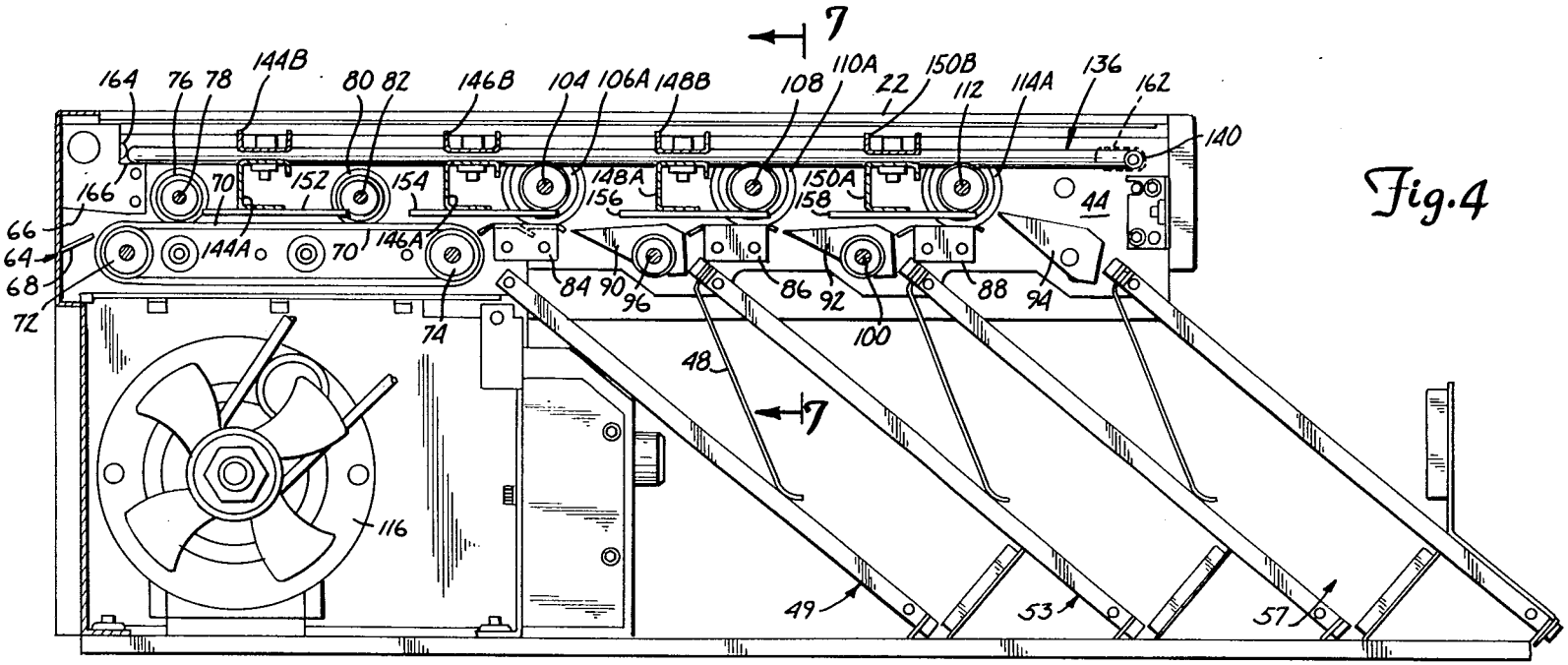
FIG. 4 is a sectional view along section 4—4 of FIG. 1.
Figure 5:
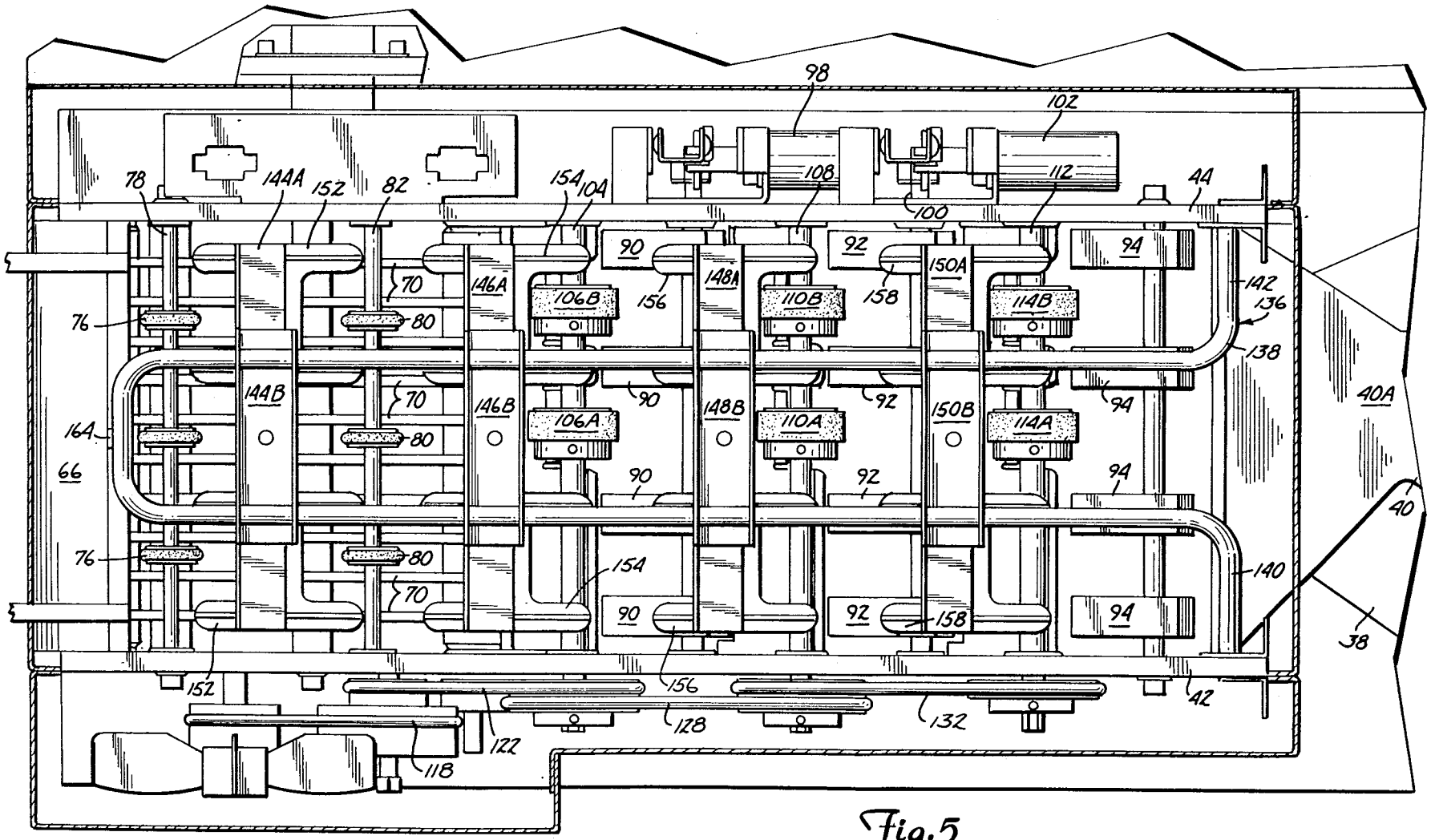
FIG. 5 is a sectional view along section 5—5 of FIG. 2.

Print sorter 10 has four inclined plates 34, 36, 38 and 40 which are connected at their lower ends to base 12 and at their upper ends to mounting plates 42 and 44 (shown in FIGS. 3–5).

Print stop 46, leaf spring 48 and plate 34 form a reject print tray assembly 49. Print stop 46 and leaf spring 48 are both connected to plate 36, which is parallel and to the right of plate 34.

Print stop 50, leaf spring 52 and plate 36 form a remake tray assembly 53 for receiving remake prints. Stop 50 and leaf spring 52 are connected to plate 38, which is parallel to and spaced to the right of plate 36.

Plate 38, print stop 54, and leaf spring 56 form a good print tray assembly 57. Plate 40 supports stop 54 and leaf spring 56.

As illustrated in FIGS. 1 and 2, each of the plates 34, 36, 38 and 40 has front and rear cut-out portions which form narrowed waist-sections 34A, 36A, 38A and 40A, respectively. The front cut-away portion of each plate permits easy access and removal of prints by an operator, by providing a portion of the prints which can be easily grasped by the operator. The rear cut-away portion provides a path for light emitted by empty tray sensor assembly 58 as well as an access area to the prints when the sorter is turned around. A light beam emitted by a light source (not shown) in sensor assembly 58 travels along a generally horizontal path which, if no prints are present in trays 49, 53 and 57, will strike reflector 60 (which is supported from plate 40 by support bracket 62) and then return to a light sensor (not shown) within sensor assembly 58. The signal from sensor assembly 58 provides an indication to the control circuitry of print sorter 10 which indicates whether prints are present in any of the trays 49, 53 and 57.

FIGS. 3, 4 and 5 show the portions of the print sorter 10 which convey photographic prints from entrance 64 to one of the print trays 49, 53 and 57. Photographic prints from the print cutter are fed through entrance 64 and are guided by print entrance block 66 and lower guide 68 onto a constantly moving conveyor formed by a plurality of O-ring belts 70 which are trained over idler shaft 72 and drive shaft 74. Idler rollers 76, which are mounted on shaft 78, and idler rollers 80 which are mounted on shaft 82 maintain the prints in contact with O-rings 70 with the proper pressure causing a clutching action.

At the exit end of the conveyor is a conveyor bed formed by first, second and third print slides 84, 86 and 88. Located between print slides 84 and 86 are reject print deflectors 90, and located between print slides 86 and 88 are remake deflectors 92. In the position shown in FIG. 4, deflectors 90 and 92 close the entrances to reject and remake print trays 49 and 53, so that a print is driven along the conveyor over first print slide 84, reject deflectors 90, second print slide 86, remake deflectors 92, and third print slide 88 to good print deflectors 94, where it is deflected downward onto good print tray 57.

Reject deflectors 90 are mounted on shaft 96, and are pivotable by operation of reject print solenoid 98 to a position which interrupts the main conveyor path and deflects prints downward onto the reject print tray 49.

Similarly, remake print deflectors 92 are mounted on shaft 100, and are pivotable by action of remake print solenoid 102 to a position which opens the entrance to remake print tray 53, and deflects prints downward onto remake print tray 53.

Positioned above first print slide 84 is drive shaft 104, on which a pair of drive rollers 106A and 106B are mounted. Drive shaft 108 is positioned over print slide 86, and a pair of drive rollers 110A and 110B are mounted on shaft 108. Drive shaft 112 extends over third print slide 88, and drive rollers 114A and 114B are mounted on shaft 112.

Motor 116 applies a drive power to drive shafts 74, 104, 108 and 112 through a series of O-ring belts and pulleys. Belt 118 extends between motor 116 and pulley assembly 120. Belt 122 transfers power from pulley assembly 20 to in-feed pulley 124 (which is connected to drive shaft 74), and to double pulley 126 (which is connected to drive shaft 104). Belt 128 extends between double pulley 126 and double pulley 130 (which is connected to drive shaft 108). Belt 132 extends between double pulley 130 and single pulley 134 (which is connected to drive shaft 112).

Guide bar assembly 136 guides the prints into rollers 80 and drive rollers 106A, 106B, 110A, 110B and 114A, 114B. Rollers 80 form the interference into the belts 70 thus creating a clutching action. Guide bar assembly 136 includes a generally U-shaped bar 138 (which has a pair of out-turned legs 140 and 142), mounting brackets 144A, 144B, 146A, 146B, 148A, 148B, 150A and 150B, and print deflector feet 152, 154, 156 and 158.

The outer end of leg 140 of guide bar 138 is positioned in a longitudinal slot 160 of forward mounting plate 42 (FIG. 3). Similarly, the outer end of leg 142 is positioned in horizontal slot 162 in mounting plate 44 (FIG. 4). Guide bar assembly 136 is held in its normal operating position (which is illustrated in the Figures) by spring loaded ball 164 which is mounted in block 66. Ball 164 engages the end of bar 138 closest to entrance 64 and holds it against shoulder 166 of block 66 and subsequently sliding guide bar assembly 136 forward and up. Guide bar assembly 136 can be pivoted upward by removing top plate 22 and pulling bar 138 out of engagement with spring loaded ball 164 and shoulder 166. This allows the operator easy access to the conveyor path in the event of a print jam.

Brackets 144A and 144B mount deflector feet 152 above the conveyor path defined by conveyor belt 70. Feet 152 prevent the prints from curling along the path between idler rollers 76 and 80.

Mounting brackets 146A and 146B support deflector feet 154, which guide prints along the conveyor path between idler roller 80 and drive rollers 106A and 106B.

Brackets 148A and 148B mount deflector feet 156 to guide prints between drive rollers 106A, 106B and drive rollers 110A, 110B. Deflector feet 158 are mounted by brackets 150A and 150B to guide prints from drive rollers 110A, 110B to drive rollers 114A, 114B.

The drive system of print sorter 10 of the present invention overcomes a problem which has been encountered with the prior art print sorters. In particular, because the drive rollers in the prior art have been spaced from the print slide, the size of the gap between the drive roller and the print slide has been extremely critical. The spacing of the drive roller from the top surface of the print slide has involved a precise and difficult adjustment because the thickness of an average print is on the order of 0.010 inches. In addition to the difficulty with drive roller position adjustment in the prior art, the very necessity to provide adjustability has complicated the mounting of these drive shafts and the drive system for driving those shafts.

With the present invention, the need for adjustment of the position of the drive shafts 104, 108 and 112 with respect to print slides 84, 86 and 88 has been eliminated by creating an interference fit between the drive rollers and the prints.

For purposes of illustration, the structure and positioning of second print slide 86 and drive rollers 110A and 110B will be specifically described. It will be understood, however, that the structure and positioning of first print slide 84 and drive rollers 106A and 106B, and the structure and positioning of third print slide 88 and drive rollers 114A and 114B are generally similar.

Figure 6B:
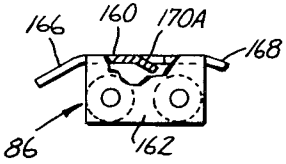
FIGS. 6A and 6B are top and front views, respectively, of one of the print slides of the print sorter.
Figure 6A:
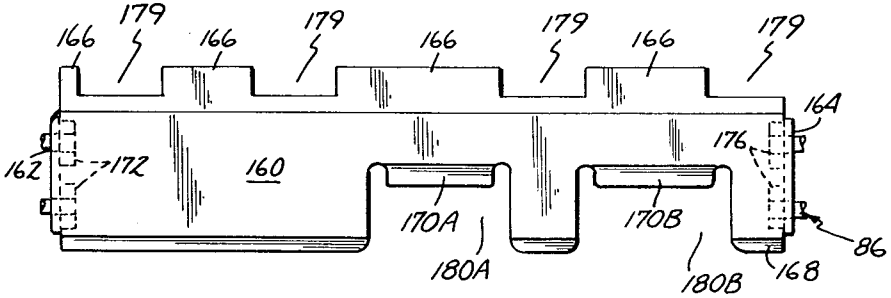

As shown in FIGS. 6A and 6B, print slide 86 has a generally horizontal top surface 160, a pair of downturned connection hinges 162 and 164, a leading edge guide lip 166, a trailing edge lip 168 and a pair of guide lips 170A and 170B. A pair of welded nuts 172 on flange 162 receive threaded bolts 174 to attach flange 162 to front mounting plate 42. Similarly, a pair of welded nuts 176 receive bolts 178 to attach flange 164 to rear mounting plate 44.

Leading edge guide lip 166 guides the leading edge of the print onto top surface 160 of second print slide 86. As shown in FIG. 6A, leading edge guide lip 166 has slots 179 to provide clearance for reject print deflectors 90. In this respect, second print slide 86 and third print slide 88 differ slightly from first print slide 84, since there is no need to slot or segment the leading edge guide lip of first print slide 84 since there are no deflectors upstream of first print slide 84.

Second print slide 86 has a pair of slots 180A and 180B which extend in the upstream direction from the trailing edge of print slide 86. Slots 180A and 180B are aligned with drive rollers 110A and 110B, respectively, to provide a recess so that the lower surface of drive rollers 110A and 110B can extend below top surface 160 of prints slide 86. Guide lips 170A and 170B provide guidance of a portion of the print into the recesses formed by slots 180A and 180B.

Drive rollers 110A and 110B have an outer radius which is greater than the radial distance from the center of drive shaft 108 to top surface 160 of second print slide 86. As a result, each print is positively engaged by drive rollers 110A and 110B, regardless of its thickness.

Figure 7:
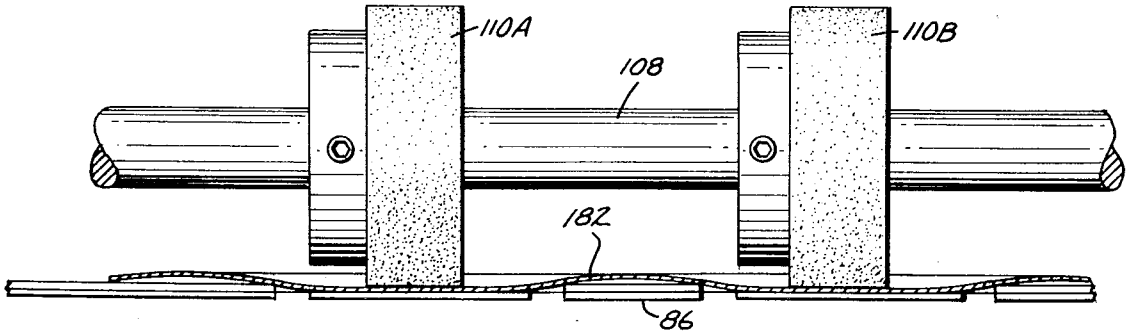
FIG. 7 is a sectional view along section 7—7 of FIG. 4 showing the interference fit between the drive rollers and a photographic print.

FIG. 7 is a partial sectional view showing a print 182 as it is being driven over second print slide 86 by drive rollers 110A and 110B. With the present invention, the total deflection of the print due to the interference fit is small. In addition, the drive rollers 110A and 110B are a compliant material (such as urethane rubber of 55 durameter). In practice, it has been found that an outer radius of drive rollers 110A and 110B which is greater than the radial distance to top surface 160 by about 0.005 inches to about 0.045 inches will not cause damage to the prints, yet will provide positive drive to the prints along the conveyor path.

With the drive system of the present invention, the tolerances for creating an interference fit between the drive rollers and the print are easily obtained using modern manufacturing techniques. This eliminates the need for adjustability of the drive shaft, and therefore simplifies the manufacture, assembly and maintenance of print sorter 10.

Although the present invention has been described with reference to preferred embodiments, workers skilled in the art will recognize that changes may be made in form and detail without departing from the spirit and scope of the invention.

What is claimed is:

1. A photographic print sorter having a conveyor path which includes a series of print drive stages for driving individual photographic prints in a longitudinal direction and having movable deflectors positioned between the print drive stages for selectively deflecting prints into print collecting trays, each print drive stage comprising:

a print slide having a top surface having a pair of recesses, the top surface supporting the prints as they are driven;

a drive shaft positioned above the top surface and the recesses, the drive shaft defining an axis of rotation which is parallel to the top surface and which extends in a transverse direction; and a pair of drive rollers mounted on the drive shaft for rotation about the axis, the drive rollers being positioned to extend into the recesses to form an interference fit between the rollers, the print slide and each photographic print as the photographic print is driven over the top surface of the print slide by the drive rollers.

2. The photographic print sorter of claim 1 wherein each drive roller has an outer radius which is between about 0.005 inches and about 0.045 inches greater than a radial distance from the axis to the top surface of the print slide.

3. The photographic print sorter of claim 2 wherein the drive rollers have an outer covering of a compliant material.

4. The photographic print sorter of claim 3 wherein the covering of compliant material is urethane rubber of about 55 durameter.

5. The photographic print sorter of claim 1 wherein the print slide has a leading edge and a trailing edge, and wherein the pair of recesses are formed by a pair of slots which extend from the trailing edge in the longitudinal direction toward the leading edge.

6. The print sorter of claim 5 wherein the print slide has a downward inclined leading edge lip at its leading edge and a downward inclined trailing edge lip at its trailing edge.

7. The print sorter of claim 6 wherein the print slide has a downward and rearward inclined guide lip at a leading end of each of the slots.

* * * * *